US008871083B2

(12) United States Patent
Peuker

(10) Patent No.: US 8,871,083 B2
(45) Date of Patent: Oct. 28, 2014

(54) METHODS AND DEVICES FOR EXTRACTING HYDROCARBONS FROM OIL SAND

(75) Inventor: Urs Peuker, Freiberg (DE)

(73) Assignee: Siemens Aktiengesellschaft, Munich (DE)

( * ) Notice: Subject to any disclaimer, the term of this patent is extended or adjusted under 35 U.S.C. 154(b) by 545 days.

(21) Appl. No.: 13/039,402

(22) Filed: Mar. 3, 2011

(65) Prior Publication Data

US 2011/0226672 A1 Sep. 22, 2011

(30) Foreign Application Priority Data

Mar. 17, 2010 (EP) ..... 10156735

(51) Int. Cl.
*C10G 1/04* (2006.01)

(52) U.S. Cl.
CPC ..... *C10G 1/04* (2013.01)
USPC ..... 208/390; 208/391

(58) Field of Classification Search
USPC ..... 208/390
See application file for complete search history.

(56) References Cited

U.S. PATENT DOCUMENTS

| | | | | |
|---|---|---|---|---|
| 3,338,814 | A | 8/1967 | Given et al. | |
| 3,542,666 | A | 11/1970 | Simpson | |
| 4,071,433 | A | 1/1978 | Hanson | 208/11 |
| 4,240,897 | A | 12/1980 | Clarke | 208/11 |
| 4,539,097 | A * | 9/1985 | Kelterborn et al. | 208/390 |
| 4,603,115 | A | 7/1986 | Schweighardt | 436/178 |
| 4,968,412 | A | 11/1990 | Guymon | 208/390 |
| 2005/0194292 | A1 * | 9/2005 | Beetge et al. | 208/391 |
| 2008/0060978 | A1 | 3/2008 | Wegner | 208/390 |
| 2008/0210602 | A1 | 9/2008 | Duyvesteyn | 208/390 |
| 2011/0180458 | A1 * | 7/2011 | Duyvesteyn et al. | 208/391 |

FOREIGN PATENT DOCUMENTS

| | | | | |
|---|---|---|---|---|
| DE | 102007039453 | A1 | 2/2009 | B03D 1/02 |
| WO | 2009/038728 | A1 | 3/2009 | C10G 1/04 |

OTHER PUBLICATIONS

Bottlinger et al, Steam Pressure Filtration for the treatment of limey soils contaminated with alipahtic hydrocarbons, Sep. 2009.*

Peuker, U.A., et al., "Steam Pressure Filtration: Mechanical-Thermal Dewatering Process", Drying Technology, 19(5), pp. 807-848, 2001.

Bottlinger, M., et al., "Steam Pressure Filtration for the Treatment of Limey Soils Contaminated with Aliphatic Hydrocarbons", 2nd Int. Containment & Remediation Technology Conference, Orlando, Florida, 4 pages, Jun. 10, 2001.

Peuker, U.A., "Applying Mechanical-Thermal Filtration for Purification, e.g. Solvent Removal", Oct. 12, 2003.

Peuker, U.A., "Abtrennung von Organischen Lösemitteln aus Filterkuchen mit Dampf", F&S Filtration und Separieren, Jahrgang 17, No. 5, pp. 230-236, 2003.

European Search Report, EP patent application No. 10156735.2-1270, 9 pages, Sep. 2, 2010.

* cited by examiner

*Primary Examiner* — Randy Boyer
*Assistant Examiner* — Juan Valencia
(74) *Attorney, Agent, or Firm* — King & Spalding L.L.P.

(57) ABSTRACT

A method and a device for carrying out the method for extracting hydrocarbons from oil sand uses organic extractants and a filter apparatus with a continuous rotary filter as well as a steaming unit.

14 Claims, 2 Drawing Sheets

METHODS AND DEVICES FOR EXTRACTING HYDROCARBONS FROM OIL SAND

CROSS-REFERENCE TO RELATED APPLICATIONS

This application claims priority to EP Patent Application No. 10156735 filed Mar. 17, 2010. The contents of which is incorporated herein by reference in its entirety.

TECHNICAL FIELD

The invention relates to a method and a device for extracting hydrocarbons from oil sand.

BACKGROUND

An oil sand is usually a mixture of clay, silicates, water and hydrocarbons. The oil phase contained at up to about 18% in oil sands, consisting of various hydrocarbons, has a widely varying composition often specific to the mining region; it may contain bitumen, crude oil and asphalt. Processing of oil sand is carried out with the aim of separating the rock or sand fraction comprising clay and silicates from the actual useful material, i.e. the oil phase comprising the hydrocarbons.

Oil sands are often extracted by surface mining. For mining from deeper strata, preliminary processing is often carried out with steam being fed into the deposit, the hydrocarbons being liquefied, collected at well sites and brought to the surface.

U.S. Pat. No. 4,240,897 describes a method for extracting bitumen from oil sand by means of hot water.

DE 10 2007 039 453 A1 describes a method for obtaining bitumen from oil sand/water mixtures by means of flotation.

According to the so-called CLARK-ROWE process, oil sand is mixed with caustic soda and the oil phase is thereby mobilized. Water-oil phase separation takes place primarily by flotation. The remaining rock or sand component still contains up to 10% of the oil phase after extraction, some of which is adsorptively bound to the surface of the very fine particles. This leads to steric stabilization of these particles in the effluent flow of the process, so that separation of these particles is made very difficult. Furthermore, a significant amount of clay is hydrophobized by adsorptive accumulation of the oil phase to such an extent that during flotation it enters into the product, i.e. the separated oil phase. There, the clay constitutes a quality-reducing contaminant which can only be separated again with difficulty. Depending on the oil sand composition, about three to four times the amount of nonrecyclable fresh water is therefore required in order to obtain one barrel of oil phase. The water is temporarily or permanently stored with the separated rock or sand fraction in collection tanks.

U.S. Pat. No. 4,968,412 describes a two-stage method for removing bitumen from oil sand, in which addition of organic solvents and separation of the clay take place in a first step. In a second step, washing of the processed oil sand is carried out with water while adding surfactant.

US 2008/0060978 A1 describes a method for extracting hydrocarbons from oil sand, in which the oil sand is mixed with organic solvents and delivered to a centrifugal separator.

U.S. Pat. No. 3,542,666 describes a method for extracting hydrocarbons from oil sand, in which organic solvents in combination with a small quantity of water in particular quantity ratios are mixed with the oil sand to form a suspension, and the pH of the suspension is adjusted to at least 5 before filtration of the suspension is carried out.

U.S. Pat. No. 4,071,433 likewise describes a method for extracting hydrocarbons from oil sand, in which the oil sand is suspended in a tank with the aid of oil. The suspension is subsequently divided into one subflow containing coarse sand and a further subflow containing fine sand, which are treated differently.

WO 2009/038728 A1 discloses a method for extracting organic substances containing hydrocarbons from oil sand. Here, the oil sand is wetted with a liquid containing turpentine and the liquid with extracted hydrocarbons is separated from residual material.

U.S. Pat. No. 4,539,097 describes a method for separating mined oil sand from a solution comprising organic solvents and bitumen by means of hydrocyclones.

US 2008/0210602 A1 describes a method for separating bitumen from oil sand by using various organic solvents, which are added to the oil sand in different solution stages or settling tanks. This is followed by vacuum filtration and recovery of the solvents used.

U.S. Pat. No. 3,338,814 describes another method for separating oil from oil sand, a froth which is produced, containing bitumen, being dewatered and the resulting dehydrated material flow subsequently being hydrocycloned.

U.S. Pat. No. 4,603,115 describes an automated analysis method for sequential solvent extraction, an ultrasound treatment of the substance to be analyzed and the respective solvent being carried out.

One problem with the extraction of hydrocarbons from oil sands with the aid of organic solvents resides inter alia in the processing the separated rock or sand fraction still containing solvent.

SUMMARY

According to various embodiments, a method and a device can be provided which further increase the efficiency of the process of extraction by using organic solvents and provide a solvent-free separated rock or sand fraction.

According to an embodiment, a method for extracting hydrocarbons from oil sand, may comprise the steps of: a1) producing a first suspension from oil sand and an first organic extractant; a2) transferring the first suspension into at least one settling tank, in the lower region of which particles of the first suspension settle by sedimentation; a3) removing a first subquantity of the first suspension from an upper region of the at least one settling tank into at least one sedimenting centrifuge, particularly in the form of a decanter, by means of which a first extract phase is separated from a residue phase; a4) forming a second suspension comprising a second subquantity of the first suspension from a lower region of the at least one settling tank and the residue phase; b1) transferring the second suspension into at least one filter apparatus comprising a continuous rotary filter, by means of which a filter cake comprising filterable particles of the second suspension is separated from a majority of second extract phase; c1) expelling a residual quantity of second extract phase from the filter cake, steam being pressurized through the filter cake by means of a first unit in the form of a steaming unit, wherein the continuous rotary filter is used in combination with the first unit so that the separations of the filter cake according to step b1) and step c1) are carried out successively in the filter apparatus; and furthermore comprising the step: d1) removing and/or combining the first and second extract phases containing the extracted hydrocarbons.

According to a further embodiment, at least one additive for influencing a settling behavior of particles contained in the first suspension may be added in step a2). According to a further embodiment, a mixture of at least two different organic solvents can be used as the first extractant. According to a further embodiment, the filter cake can be subjected to a first washing step between steps c1) and d1), the filter cake being washed with at least one second organic extractant. According to a further embodiment, a chemical composition of the first extractant and optionally of the at least one second extractant can be adjusted as a function of a content in the oil sand of molecules containing ≥10 carbon atoms, in particular cycloalkanes and/or naphthenic acids and/or asphaltenes. According to a further embodiment, a mixture of at least two different organic solvents can be used as the second extractant. According to a further embodiment, the filter cake can be washed during the first washing step in chronological succession with second extractants which differ in their chemical composition. According to a further embodiment, the second extractants may comprise organic solvents which differ in their boiling temperatures, a concentration of that solvent which has a lowest boiling temperature in comparison with the other solvents respectively increasing in the successively used second extractants. According to a further embodiment, the filter cake can be subjected to a second washing step between the first washing step and step d1), the filter cake being washed with a third organic extractant consisting of a pure organic solvent which has a lower boiling temperature than water. According to a further embodiment, separation of the hydrocarbons from the first and second extract phases can be carried out after step d1), and a remaining liquid mixture is processed by the organic solvents contained being separated purely and used in order to form the first extractant and/or the at least one second extractant and/or the third extractant.

According to another embodiment, a device for carrying out the method as described above, may comprise—at least one first dosing instrument for adding the first extractant to the oil sand;—at least one mixer for producing the first suspension; —at least one settling tank;—optionally at least one second dosing instrument for adding at least one additive to the first suspension;—at least one sedimenting centrifuge, particularly in the form of a decanter, arranged downstream of the at least one settling tank;—at least one collecting tank for forming the second suspension, arranged downstream of the at least one settling tank and the at least one sedimenting centrifuge;—at least one filter apparatus, comprising a continuous rotary filter, arranged downstream of the at least one collecting tank;—optionally at least one third dosing instrument for applying the at least one second extractant and optionally the third extractant to the filter cake;—at least one first unit in the form of a steaming unit, which is integrated into the filter apparatus; and—at least one second unit for removing and/or combining the first and second extract phases containing the extracted hydrocarbons.

According to a further embodiment of the device, there may be furthermore an analysis instrument for determining the content in the oil sand of molecules having ≥10 carbon atoms, in particular of cycloalkane and/or naphthenic acid and/or asphaltene type, which is connected to a control instrument for adjusting the chemical compositions of the first extractant and optionally the at least one second extractant as a function of the content determined. According to a further embodiment of the device, the may furthermore comprise at least one processing system for processing the liquid mixture remaining after separation of the hydrocarbons from the extract phase or the first and second extract phases. According to a further embodiment of the device, the device may furthermore comprise at least one recycling instrument for recycling at least one organic solvent separated purely from the liquid mixture to at least one of the dosing instruments. According to a further embodiment of the device, the continuous rotary filter can be formed as a drum filter.

BRIEF DESCRIPTION OF THE DRAWINGS

FIG. 2 shows a detail of FIG. 1 in the region of the filter apparatus carrying out the steam pressure filtration.

DETAILED DESCRIPTION

Figure 1:
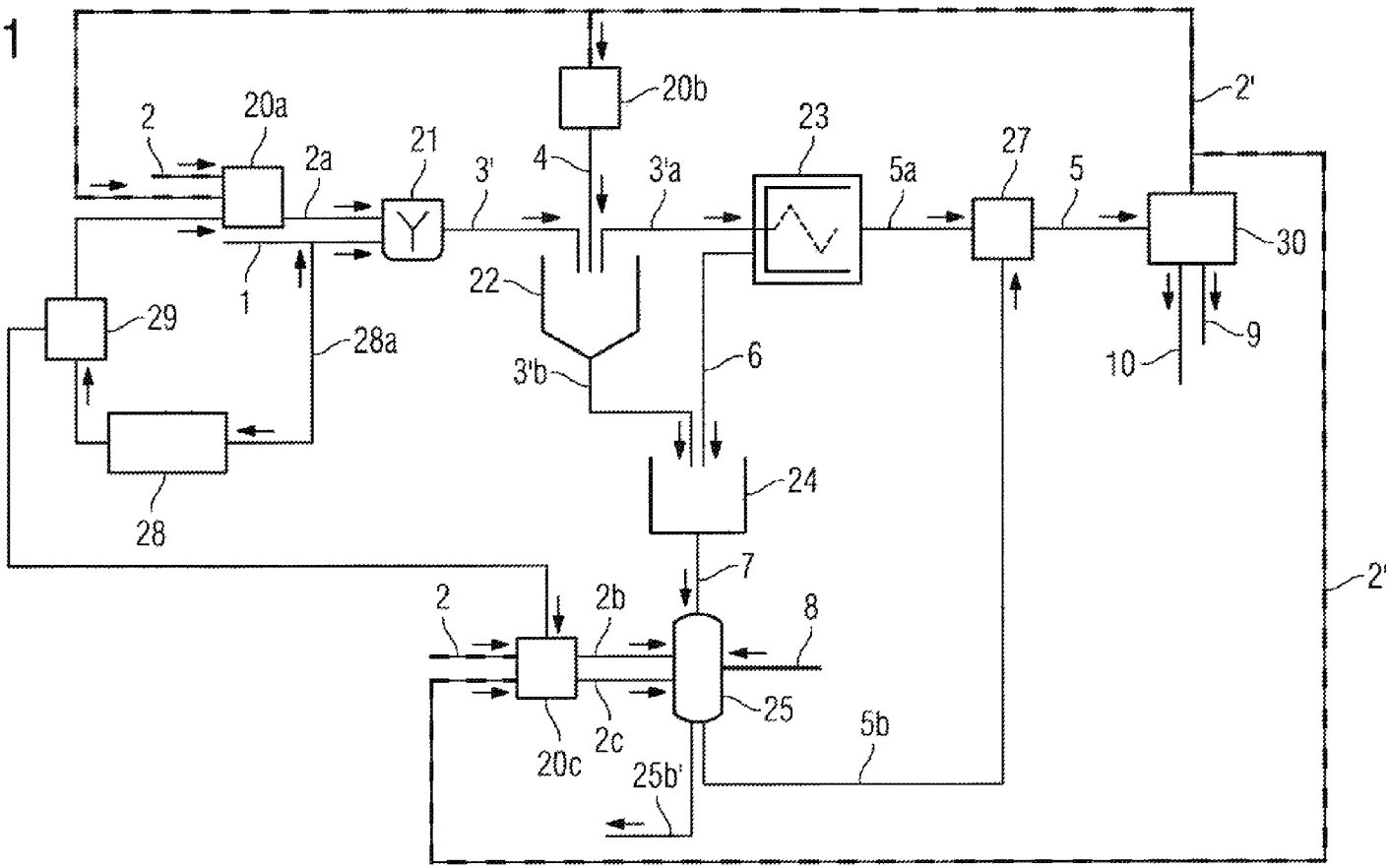
FIGS. 1 and 2 are intended to explain a possible method according to various embodiments, and a device which can be used for this, by way of example. Thus, FIG. 1 schematically shows a method and a device using steam pressure filtration.

As stated above according to various embodiments, the method for extracting hydrocarbons from oil sand, may comprise the following steps:

a1) producing a first suspension from oil sand and a first organic extractant;

a2) transferring the first suspension into at least one settling tank, in the lower region of which particles of the first suspension settle by sedimentation;

a3) removing a first subquantity of the first suspension from an upper region of the at least one settling tank into at least one sedimenting centrifuge, particularly a decanter, by means of which a first extract phase is separated from a residue phase;

a4) forming a second suspension comprising a second subquantity of the first suspension from a lower region of the at least one settling tank and the residue phase;

b1) transferring the second suspension into at least one filter apparatus comprising a continuous rotary filter, by means of which a filter cake comprising filterable particles of the second suspension is separated from a majority of second extract phase;

c1) expelling a residual quantity of second extract phase from the filter cake, steam being pressurized through the filter cake by means of a first unit in the form of a steaming unit, wherein the continuous rotary filter is used in combination with the first unit so that the separations of the filter cake according to step b1) and step c1) are carried out successively in the filter apparatus; and furthermore comprising the step:

d1) removing and/or combining the first and second extract phases containing the extracted hydrocarbons.

According to other embodiments, a device for carrying out the method as mentioned above may comprise the following:

at least one first dosing instrument for adding the first extractant to the oil sand;

at least one mixer for producing the first suspension;

at least one settling tank;

optionally at least one second dosing instrument for adding at least one additive to the first suspension;

at least one sedimenting centrifuge, particularly in the form of a decanter, arranged downstream of the at least one settling tank;

at least one collecting tank for forming the second suspension, arranged downstream of the at least one settling tank and the at least one sedimenting centrifuge;

at least one filter apparatus, comprising a continuous rotary filter, arranged downstream of the at least one collecting tank;

optionally at least one third dosing instrument for applying at least one second extractant and/or a third extractant to the filter cake;

at least one first unit in the form of a steaming unit, which is integrated into the filter apparatus; and at least one second unit for removing and/or combining the first and second extract phases containing the extracted hydrocarbons.

The method and the device according to various embodiments permit a highly effective extraction process, in which at least 85 to 98% of the hydrocarbons contained in the oil sand can be separated. The device according to various embodiments can readily be configured on a scale such that at least 100 000 barrels of oil phase can be obtained per day. The separated rock and sand fraction, containing clay, is essentially free of extractants and oil phase, and can generally be returned into the ground directly at the mining site of the oil sand. This is particularly economical and environmentally friendly, and saves on storage areas.

It has been found that the effect of using purely organic extractants for the method according to various embodiments is that very fine components in the oil sand, which predominantly consist of clay, agglomerate and the agglomerates also exhibit a hydrophobic behavior. This allows separation of the clay with the rock and sand fraction by means of particularly economical mechanical solid-liquid filtration which is easy to carry out. The expulsion of the residual quantity of second extract phase from the filter cake in step c1) of the method is carried out according to various embodiments by pressurizing steam through the filter cake. Such a procedure is also referred to in the literature as steam pressure filtration.

The fundamentals of steam pressure filtration are known, and described for example in the following publications:

"Steam Pressure Filtration: Mechanical-Thermal Dewatering Process", U. A. Peuker, W. Stahl, Drying Technology, 19(5), pages 807-848 (2001);

"Applying mechanical-thermal filtration processes for purification, e.g. solvent removal", U. A. Peuker, Proc. Filtech Europe, 12-23 Oct. 2003, Düsseldorf, Germany;

"Abtrennung von organischen Lösemitteln aus Filterkuchen mit Dampf" [Separation of organic solvents from filter cakes by steam], U. A. Peuker, F & S Filtrieren and Separieren, volume 17 (2003), No. 5, pages 230 to 236;

"Steam Pressure Filtration for the treatment of limey soils contaminated with aliphatic hydrocarbons", by M. Bottlinger, H. B. Bradl, A. Krupp, U. Peuker, $2^{nd}$ Int. Containment & Remediation Technology Conference, 10-13 Jun. 2001, Orlando, Fla., USA.

The filter cake, comprising the rock or sand fraction of the oil sand, is freed from organic extractant by pressurizing the steam through, and a quantity of hydrocarbons dissolved therein, or oil phase, is expelled with the extractant. This increases the yield of hydrocarbons, i.e. improves to about 95 to 98% the degree of separation which characterizes the success of the separation.

The thickness of the filter cake to be treated in this way preferably may lie in the range of from 2 to 100 mm, preferably in the range of from 5 to 25 mm. The filter cake to be treated is subsequently free of organic solvents and volatile hydrocarbons and can be returned into the ground directly, for example in the region of the mining site of the oil sand. Separate storage of the separated rock or sand fraction is obviated. It is only capable of containing a small proportion of nonvolatile hydrocarbons.

The first unit of the device according to various embodiments is formed as a steaming unit in order to carry out step c1) of the method. According to various embodiments, the steaming unit is integrated into the filter apparatus. This achieves an arrangement which saves on space and resources.

As alternative, the filter cake may also be treated by vacuum drying or hot steam stripping in step c1) of the method. This, however, is less efficient than the above-described treatment of the filter cake by means of steam pressure filtration.

The filter apparatus comprises a continuous filter in the form of a rotary filter. The rotary filter is in particular a drum filter. The rotary filter may be preferably equipped with a steaming unit in the form of a steam hood. In this way, steps b1) and c1) can be successively carried out directly inside the filter apparatus. This saves time and reduces the space requirement for the device in question.

It has proven suitable for at least one additive for influencing a settling behavior of particles contained in the first suspension to be added in step a2) of a method. A thickener may be preferably added as the additive. This reinforces the settling of particles in the suspension, or the rock or sand fraction including the clay of the oil sand.

As the first extractant, which is suspended with the oil sand, it may be preferable to use a mixture of at least two different organic solvents. Here, mixtures comprising at least two organic solvents from the group consisting of toluene, benzene, heptane and hexane can be particularly preferred, although other organic solvents may also be used for this. As an alternative, a pure organic solvent, preferably in the form of toluene or heptane, may be used to form the first suspension together with the oil sand. It is likewise possible to use industrial solvents such as paraffin, naphtha, gasoline or kerosene with a chemical composition varying owing to manufacture.

According to an embodiment, the filter cake is subjected to a first washing step between steps c1) and d1), the filter cake being washed with at least one second organic extractant. The chemical compositions of the first extractant and of the at least one second extractant may be preferably different in this case.

The chemical compositions of the first extractant and optionally of the at least one second extractant may in this case be preferably adjusted as a function of a content in the oil sand of molecules containing ≥10 carbon atoms, in particular bulky molecules from the group consisting of cycloalkanes and/or naphthenic acids and/or asphaltenes.

To this end, the device according to various embodiments preferably may have an analysis instrument for determining the content of such molecules in the oil sand, which is connected to a control instrument for adjusting the chemical composition of the first extractant and optionally the at least one second extractant as a function of the content determined. The control instrument sends a corresponding control signal to the first dosing instrument and optionally the further or third dosing instrument.

This is because in the case of a purely aliphatic extraction, a solubility of such bulky molecules in some organic solvents has proven problematic. When using paraffins as extractants, for example, the cycloalkanes and naphthenic acids precipitate as gel-like solid structures. This reduces the yield and impairs the processability of the oil phase.

Carrying out the first washing step improves the efficiency of the extraction. It is not problematic for the first extractant and the at least one second extractant to be composed differently. The at least one second extractant is in this case fully soluble in the first extractant.

As the second extractant, it can be preferable to use a mixture of at least two different organic solvents. In this case, the filter cake may preferably be washed during the first washing step in chronological succession with second extractants which differ in their chemical composition.

The second extractants preferably may comprise organic solvents which differ in their boiling temperatures; a concentration of that solvent which has a lowest boiling temperature in comparison with the other solvents respectively increases in the successively used second extractants. In the course of the first washing, the proportion of volatile solvents in the second extractant therefore increases. This allows particularly effective washing out of nonvolatile solvents and hydrocarbons from the filter cake.

In particular, the filter cake is subjected to a second washing step between the first washing step and step d1), the filter cake being washed with a third organic extractant consisting of a pure organic solvent which has a lower boiling temperature than water. It preferably also may have a lower boiling temperature than the first extractant and optionally the at least one second extractant. The efficiency of the extraction can be further increased in this way.

When a boiling temperature is referred to in this document, it is always intended to mean the boiling temperature of a substance at standard pressure.

After the second washing step, there is a liquid in the filter cake which corresponds essentially to the third extractant. In the subsequent step c1) of the method, the third extractant can be removed particularly effectively from the filter cake owing to its boiling temperature lying below that of water, in particular by means of steam pressure filtration.

Based on carrying out both the first and second washing steps, about 98% of the oil phase can be extracted from the oil sand.

After step d1) of the method, separation of the hydrocarbons from the first and second extract phases is in particular carried out. A remaining liquid mixture is processed by the organic solvents contained being separated purely and used in order to form the first extractant and/or the at least one second extractant and/or the third extractant. The organic solvents used for the extraction and to form the various extractants are accordingly recycled individually and reused in the extraction process.

To this end, the device preferably may comprise at least one processing system for processing the liquid mixture remaining after separation of the hydrocarbons from the extract phase or the first and second extract phases.

It may be furthermore preferable for there to be at least one recycling instrument for recycling at least one organic solvent separated from the liquid mixture to at least one of the dosing instruments.

FIG. 1 schematically shows a method and a device using steam pressure filtration. A first suspension 3' is produced from oil sand 1 and a first organic extractant 2*a*. The first extractant 2*a* is provided via a first dosing instrument 20*a*, which produces a mixture of organic solvents 2, here inter alia for example toluene and heptane, in the desired mixing ratio. The mixing ratio is set by a control instrument 29. The control instrument 29 receives the setpoint value for the mixing ratio from an analysis instrument 28, which carries out sampling 28*a* on the oil sand 1 and a chemical analysis of the oil sand 1 at regular time intervals.

By means of the chemical analysis, a proportion of hydrocarbons in the oil sand 1 having bulky molecules and a number of carbon atoms 10, in particular cycloalkanes, naphthenic acids and asphaltenes, is determined. Depending on which hydrocarbon compounds having bulky molecules are present, and in what quantities, the analysis instrument 28 determines an optimal composition of the first extractant 2*a* and sends a corresponding signal to the control instrument 29, which makes the first dosing instrument 20*a* provide the first extractant 2*a* in the determined composition and mix it with the oil sand 1. This prevents the bulky molecules from forming gel-like compounds with a solvent 2 of the first extractant 2*a*, these being extractable only with difficulty.

The oil sand 1 and the first extractant 2*a* are suspended in a mixer 21. The first suspension 3' which is formed is transferred into a settling tank 22 with the optional addition of an additive 4. The additive 4 is optionally formed by a thickener, which is delivered to the suspension 3' by means of a second dosing instrument 20*b*. Particles of the first suspension 3' settle in the lower region of the settling tank by sedimentation. A first subquantity 3'*a* of the first suspension 3' is now transferred from an upper region of the settling tank 22 into at least one sedimenting centrifuge, here in the form of a decanter 23, by means of which a first extract phase 5*a* comprising a first quantity of extracted hydrocarbons 10 and first extractant 2*a* is separated from a residue phase 6.

A second suspension 7 comprising a second subquantity 3'*b* of the first suspension 3' is now formed in a collecting tank 24 from the lower region of the at least one settling tank 22 and the residue phase 6. The second suspension 7 is transferred into a filter apparatus 25, by means of which a filter cake 25*b* comprising filterable particles of the second suspension 7 is separated from a majority of second extract phase 5*b* comprising a second quantity of extracted hydrocarbons 10 and first extractant 2*a*. A residual quantity of second extract phase 5*b* is furthermore expelled from the filter cake 25*b* (cf. FIG. 2).

A second extractant 2*b* is used in order to carry out a first washing step on the filter cake 25, and a third extractant 2*c* is used in order to carry out a second washing step on the filter cake so as to expel residual quantities of second extract phase from the filter cake 25*b*. These are applied by means of at least one third dosing instrument 20*c* onto the filter cake 25*b* to be washed, in a dosed fashion (cf. FIG. 2).

Figure 2:
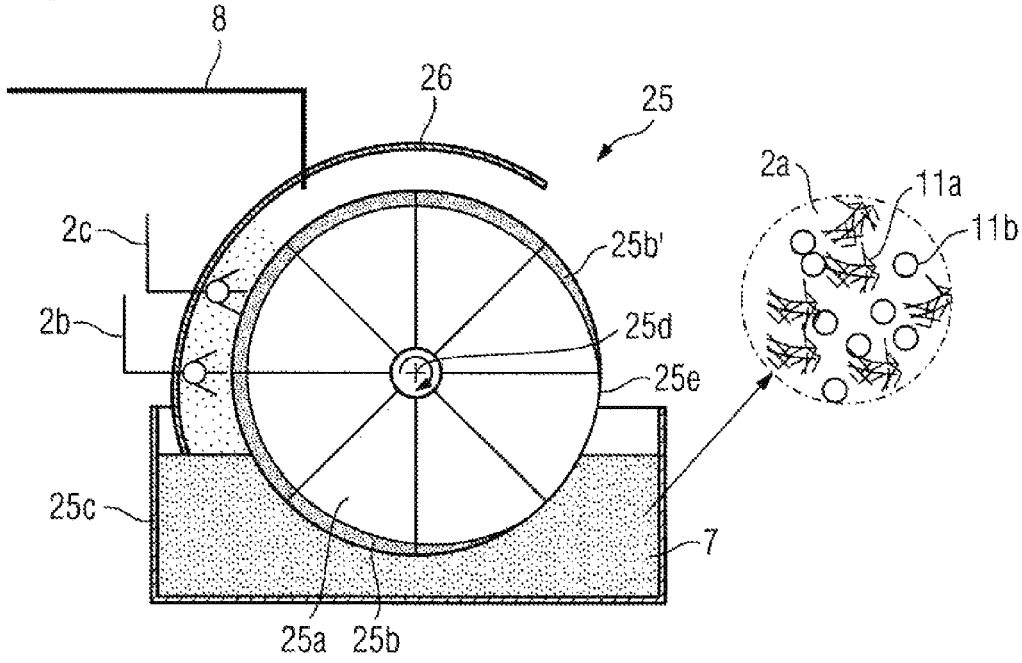

The structure of a possible filter apparatus 25 for carrying out steam pressure filtration can be seen in the cross section of FIG. 2. The filter apparatus 25 comprises a tank 25*c* for holding the second suspension 7 and a continuous rotary filter, here a drum covered with filter fabric 25*e*, i.e. a drum filter 25*a* having a plurality of mutually separated filter chambers. The drum filter 25*a* is rotated in the arrow direction about a drum axis 25*d*, at least in some of the filter chambers there being a pressure which is less than that above the filter fabric 25*e*. Liquid is thus sucked from the second suspension 7 through the filter fabric 25*e* into the respective filter chamber and, on the filter fabric 25*e*, a filter cake 25*b* is formed whose thickness increases with an increasing residence time of the filter fabric 25*e* in the second suspension 7. The filter cake 25*b* comprises filterable particles of the second suspension 7, i.e. clay agglomerates 11*a* and other particles of the stone and sand fraction 11*b*. A second extract phase 5*b* comprising a second quantity of hydrocarbons and first extractant 2*a* is separated and removed from the filter chambers in the region of the drum axis 25*d*.

The drum filter 25*a* continuously rotates further, so that the filter cake 25*d* emerges from the second suspension 7. A first washing step can now be preferably carried out on the filter cake 25*b*, in which at least one second organic extractant 2*b*, here for example consisting of toluene and heptane, is applied onto the filter cake 25*b* on a side facing away from the filter fabric 25*e*. The second extractant 2*b* displaces a residual quantity of second extract phase 5*b*, comprising the first extractant 2*a*, from the open pore space of the filter cake 25*b*. For better clarity, FIG. 2 only represents addition of one second extractant 2*b*, which is applied onto the filter cake 25*b*. Here, however, a plurality of different second extractants 2*b* may be preferably applied successively onto the filter cake 25*b*.

Preferably, a second washing step may be subsequently carried out, in which a third extractant 2*c*, here for example pure hexane or heptane, is applied onto the filter cake 25*b* on its side facing away from the filter fabric 25*e*. The third extractant 2*c* displaces a further residual quantity of second extract phase 5*b*, comprising the second extractant 2*b*, from the open pore space of the filter cake 25*b*.

A first unit 26 in the form of a steaming unit is integrated into the filter apparatus 25. The steaming unit comprises a steam hood, which surrounds a part of the drum filter 25*a*. Steam 8 is fed into the steam hood over the filter cake 25*b* and taken in by it. A residual quantity of second extract phase 5*b* still present in the filter cake 25*b*, comprising the third extractant 2*c*, is thereby removed. The steam 8 is pressurized through the filter cake 25*b* and the filter cake 25*b* is freed of second extract phase 5*b* comprising the third extractant 2*c*.

The quantities of second extract phase 5*b* respectively entering the filter chambers are collected in the region of the drum axis 25*d* and removed from the filter apparatus 25 by means of a second unit (not represented in detail here), for example in the form of a tube. As the filter residue 25*b*', a substantially dehydrated, solvent-free filter cake remains, which is removed from the filter fabric 25*e* for example by compressed air and/or a mechanical scraper and, for example, can be returned to the ground at the mining site of the oil sand 1.

The composition of the at least one second extractant 2*b* is set by the control instrument 29 as a function of the chemical analysis of the oil sand 1 (see FIG. 1). Thus, when there is a change in the composition of the first extractant 2*a*, the composition of the at least one second extractant 2*b* may be preferably also modified and adapted. Second extractants 2*b* used successively during the first washing step preferably may comprise organic solvents 2 which differ in their boiling temperatures, a concentration of that solvent 2 which has a lowest boiling temperature in comparison with the other solvents 2 respectively increasing in the successively used second extractants 2*b*. In the course of the first washing step, the proportion of volatile solvents 2 in the second extractant 2*b* therefore increases. This allows particularly effective washing out of nonvolatile solvents and hydrocarbons from the filter cake 25*b* and effective full removal of the solvent from the filter cake 25*b* by steam pressure filtration.

The second extract phase 5*b*, which can be removed from the filter apparatus 25, is combined in a second unit 27 (see FIG. 1) with the first extract phase 5*a* which comes from the decanter 23, to form the extract phase 5. This is delivered to a processing system 30, which separates the hydrocarbons 10 extracted from the oil sand 1 and separates the organic solvents 2 purely. The purely recovered solvents 2' may be supplied to the first dosing instrument 20*a* or the third dosing instrument 20*c*, and used to form the desired first, second and third extractants 2*a*, 2*b*, 2*c*. The second dosing instrument 20*b* may if necessary be supplied with fresh or recycled solvents 2, 2', for example in order to mix the additive 4 therewith before addition to the first suspension 3', or dissolve it therein. Remaining small quantities of residues from the processing system 30, for example in the form of water 9 etc., are removed separately.

FIGS. 1 and 2 merely show examples of possible methods and devices according to various embodiments. A person skilled in the art is, for example, readily capable of operating a plurality of mixers and/or settling tanks in parallel and arranging merely one sedimenting centrifuge, in particular a decanter, and/or one filter apparatus downstream of them. Likewise, a plurality of filter apparatuses connected in parallel may be arranged downstream of one settling tank and one or more sedimenting centrifuges, in particular one or more decanters, etc.

What is claimed is:

1. A method for extracting hydrocarbons from oil sand, comprising the steps:

a1) producing a first suspension from oil sand and a first organic extractant;

a2) transferring the first suspension into at least one settling tank, in the lower region of which particles of the first suspension settle by sedimentation;

a3) removing a first subquantity of the first suspension from an upper region of the at least one settling tank into at least one sedimenting centrifuge, which may have the form of a decanter, by means of which a first extract phase containing extracted hydrocarbons is separated from a residue phase;

a4) forming a second suspension comprising (i) a second subquantity of the first suspension from a lower region of the at least one settling tank and (ii) the residue phase, but not the separated first extract phase, from the at least one sedimenting centrifuge;

b1) transferring the second suspension into at least one filter apparatus comprising a continuous rotary filter, by means of which a filter cake comprising filterable particles of the second suspension is separated from a majority of second extract phase;

c1) expelling a residual quantity of second extract phase containing extracted hydrocarbons from the filter cake, by pressurizing steam through the filter cake by means of a first steaming unit, wherein the continuous rotary filter is used in combination with the first unit so that the separations of the filter cake according to step b1) and step c1) are carried out successively in the filter apparatus; and d1) delivering the first extract phase seperated by the at least one sedimenting centrifuge and the second extract phase expelled from the filter cake to a processing system, wherein the first extract phase separated by the at least one sedimenting centrifuge bypasses the at least one filter apparatus.

2. The method according to claim 1, wherein at least one additive for influencing a settling behavior of particles contained in the first suspension is added in step a2).

3. The method according to claim 1, wherein a mixture of at least two different organic solvents is used as the first extractant.

4. The method according to claim 1, wherein the filter cake is subjected to a first washing step between steps c1) and d1), the filter cake being washed with at least one second organic extractant.

5. The method according to claim 1, wherein a chemical composition of the first extractant is adjusted as a function of a content in the oil sand of molecules containing ≥10 carbon atoms.

6. The method according to claim 5, wherein the molecules are at least one of cycloalkanes, naphthenic acids, and asphaltenes.

7. The method according to claim 4, wherein a mixture of at least two different organic solvents is used as the second extractant.

8. The method according to claim 4, wherein a chemical composition of the at least one second extractant is adjusted as a function of a content in the oil sand of molecules containing ≥10 carbon atoms.

9. The method according to claim 8, wherein the molecules are at least one of cycioalkanes, naphthenic acids, and asphaltenes.

10. The method according to claim 8, wherein a mixture of at least two different organic solvents is used as the second extractant.

11. The method according to claim 4, wherein the filter cake is washed during the first washing step in chronological succession with second extractants which differ in their chemical composition.

12. The method according to claim 11, wherein the second extractants comprise organic solvents which differ in their boiling temperatures, a concentration of that solvent which has a lowest boiling temperature in comparison with the other solvents respectively increasing in the successively used second extractants.

13. The method according to claim 4, wherein the filter cake is subjected to a second washing step between the first washing step and step d1), the filter cake being washed with a third organic extractant consisting of a pure organic solvent which has a lower boiling temperature than water.

14. The method according to claim 1, wherein separation of the hydrocarbons from the first and second extract phases is carried out after step d1), and a remaining liquid mixture is processed by the organic solvents contained being separated purely and used in order to form at least one of the first extractant, the at least one second extractant, and the third extractant.

* * * * *